US007778824B2

(12) United States Patent
Mo et al.

(10) Patent No.: US 7,778,824 B2
(45) Date of Patent: Aug. 17, 2010

(54) DEVICE AND METHOD FOR FRAME LOST CONCEALMENT

(75) Inventors: Yunneng Mo, Shenzhen (CN); Yulong Li, Shenzhen (CN); Fanrong Tang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 12/330,265

(22) Filed: Dec. 8, 2008

(65) Prior Publication Data

US 2009/0089050 A1 Apr. 2, 2009

Related U.S. Application Data

(63) Continuation of application No. PCT/CN2007/070092, filed on Jun. 7, 2007.

(30) Foreign Application Priority Data

Jun. 8, 2006 (CN) ..... 2006 1 0087475

(51) Int. Cl.
*G10L 11/04* (2006.01)

(52) U.S. Cl. ..... 704/207

(58) Field of Classification Search ..... 704/207, 704/223, 209, 216, 217, 218, 219, 221, 222, 704/200, 205
See application file for complete search history.

(56) References Cited

U.S. PATENT DOCUMENTS 5,960,386 A * 9/1999 Janiszewski et al. ..... 704/207
7,587,315 B2 * 9/2009 Unno ..... 704/223

FOREIGN PATENT DOCUMENTS

WO WO-00/63885 10/2000
WO WO-2005/086138 9/2005

OTHER PUBLICATIONS

ITU-T Recommendations G.711-Appendix I: A high quality low-complexity algorithm for packet loss concealment with G.711, ITU-T, p. 2-5, Sep. 30, 1999.
ITU-T Recommendation G.729-Coding of speech at 8kbit/s using conjugate-structure algebraic-code-excited linear-prediction (CS-ACELP), ITU-T, p. 25-32, Mar. 19, 1996.

* cited by examiner

*Primary Examiner*—Huyen X. Vo
(74) *Attorney, Agent, or Firm*—Brinks Hofer Gilson & Lione

(57) ABSTRACT

A device and a method for frame lost concealment are disclosed. A pitch period of a current lost frame is obtained on the basis of a pitch period of the last good frame before the current lost frame. An excitation signal of the current lost frame is recovered on the basis of the pitch period of the current lost frame and an excitation signal of the last good frame before the lost frame. Thereby, the hearing contrast of a receiver is reduced, and the quality of speech is improved. Further, in the present invention, a pitch period of continual lost frames is adjusted on the basis of the change trend of the pitch period of the last good frame before the lost frame. Therefore, a buzz effect produced by the continual lost frames is avoided, and the quality of speech is further improved. In addition, by attenuating the energy of the excitation signal obtained from the continual lost frames, the device and method accord with the hearing physiological characteristics of human and reduce the hearing contrast of the receiver.

11 Claims, 4 Drawing Sheets

DEVICE AND METHOD FOR FRAME LOST CONCEALMENT

CROSS-REFERENCE TO RELATED APPLICATIONS

This application is a continuation of International Application No. PCT/CN2007/070092, filed on Jun. 7, 2007, which claims priority to Chinese Patent Application No. 200610087475.4, filed on Jun. 8, 2006, entitled "DEVICE AND METHOD FOR LOST FRAME CONCEALMENT", both of which are incorporated herein by reference in their entireties.

FIELD OF THE INVENTION

The present invention relates to a technical field of speech coding/decoding, and more particularly to a device and a method for frame lost concealment.

BACKGROUND

Voice over IP (VoIP) achieves speech communication through switching processing such as speech compressed encoding, packaging and packeting, routing distribution, storage and switching, and depackaging and decompression over the IP network or Internet. The coding technology is a key to VoIP, and can be classified into waveform coding, parametric coding, and hybrid coding. The waveform coding occupies a large bandwidth and is inapplicable to circumstances with insufficient bandwidths.

In order to enhance the transmission efficiency of VoIP in the case of limited bandwidths, a low bit rate coding/decoding method is proposed in the industry. International Telecommunication Union-Telecommunication Standardization Sector (ITU_T) publicized Telephone Bandwidth Speech Coding Standard G.729 in March of 1996, in which a conjugate-structure algebraic-code-excited linear-prediction (CS-ACELP) speech coding/decoding scheme is employed for speech signals with a code rate of 8 kb/s. Later on, ITU_T successively publicized G.729 Annex A and Annex B in November, 1996 to further optimize the G.729.

CS-ACELP is a coding mode on the basis of code-excited linear-prediction (CELP). Every 80 sampling points constitutes one speech frame. A speech signal is analyzed and then various parameters are extracted, such as linear-prediction filter coefficient, codebook sequence numbers in adaptive and fixed codebooks, adaptive code vector gain, and fixed code vector gain. These parameter codes are then sent to a decoding end. At the decoding end, as shown in FIG. 1, a received bit stream is first recovered into the parameter codes, and the parameter codes are then decoded into the parameters. An adaptive code vector is obtained from an adaptive codebook via an adaptive sector sequence number thereof. A fixed code vector is obtained from a fixed codebook via an adaptive sector sequence number thereof. Afterward, the obtained vectors are respectively multiplied by their own gains $g^c$ and $g^p$, and then added point by point to construct an excitation sequence. A linear-prediction filter coefficient is employed to constitute a short-term filter. A so-called adaptive codebook method is adopted to implement a long-term or fundamental-tone synthesis filtering. After a synthetic speech is calculated, a long-term post-filter is employed to further improve the quality of speech.

However, when transmitted in a network, it is inevitable that an IP packet may be damaged during the transmission, discarded due to the network congestion, lost due to network failures, or even discarded just because it arrives at a receiving end too late and cannot be included in the replayed speech. Frame loss is the main reason for degradation in speech quality during the network transmission. Lost IP frames will not recur at the decoding end. When one codebook or several adjacent continuous codebooks are lost, the CS-ACELP decoder is confronted with two problems. One is the loss of all code elements contained in a group of sequentially arranged excitation signals. At this point, alternative excitation signals capable of generating the smallest speech quality distortion and transiting smoothly need to be obtained by calculation. When a frame loss occurs, all original adaptive codebook parameters, short-term linear-prediction filter coefficients, and gains are lost. Since the G.729 adopts a backward-adaptive coding mode, speech signals can be converged only after a certain period of time when a next good frame is received. Therefore, in the case of frame loss, the quality of speech of the G.729 decoder degrades rapidly.

Aiming at the frame loss phenomenon of the G.729, the G.729 Standard adopts a frame lost concealment technology of high-performance and low-complexity. Referring to FIG. 2, this technology includes the following steps.

In Step 201, a current lost frame is detected, and a long-term prediction gain of the last 5 ms good sub-frame before the lost frame is obtained from a long-term post-filter.

In practice, good frames such as speech frames or mute frames are forwarded to a frame lost concealment processing device by an upper-layer protocol layer such as a real-time transfer protocol (RTP) layer. A lost frame detection is also completed by the upper-layer protocol layer. On receiving a good frame, the upper-layer protocol layer directly forwards the good frame to the frame lost concealment processing device. When detecting a lost frame, the upper-layer protocol layer sends a frame loss indication to the frame lost concealment processing device; the frame lost concealment processing device receives the frame loss indication and determines that a frame loss occurs currently.

In Step 202, it is determined whether the long-term prediction gain of the last 5 ms good sub-frame before the lost frame is larger than 3 dB. If yes, the current lost frame is considered as a periodic frame, i.e., speech, and Step 203 is performed; otherwise, the current lost frame is considered as a non-periodic frame, i.e., non-speech, and Step 205 is performed.

In Step 203, a fundamental-tone delay of the current lost frame is calculated on the basis of a fundamental-tone delay of the last good frame before the lost frame. An adaptive codebook gain of the current lost frame is obtained by attenuating the energy of an adaptive codebook gain of the last good frame before the lost frame. Further, an adaptive codebook of the last good frame before the lost frame is taken as an adaptive codebook of the current lost frame.

In particular, the process of calculating the fundamental-tone delay of the current lost frame includes the following steps. First, an integer part T of the fundamental-tone delay of the last good frame before the lost frame is taken. If the current lost frame is an nth frame in continual lost frames, the fundamental-tone delay of the current lost frame equals T plus (n−1) sampling point durations. In order to avoid an excessive periodicity of the frame loss, the fundamental-tone delay of the lost frame is limited to a value no greater than that obtained by adding T to 143 sampling point durations.

In the G.729, a frame is 10 ms long and contains 80 sampling points. Thus, one sampling point lasts for 0.125 ms.

An adaptive codebook gain of the first lost frame in the continual lost frames is set to be identical with the adaptive codebook gain of the last good frame before the lost frame. Adaptive codebook gains of the second lost frame and lost frames after the second one in the continual lost frames are attenuated with an attenuation coefficient of 0.9 on the basis of the adaptive codebook gain of a former lost frame. That is, the adaptive codebook gain of the current lost frame is $g_p^n=0.9g_p^{n-1}$.

n represents a frame number of the current lost frame in the continual lost frames, $g_P^n$ is the adaptive codebook gain of the current lost frame, n−1 represents a frame number of a former lost frame of the current lost frame in the continual lost frames, $g_P^{n-1}$ is an adaptive codebook gain of the former lost frame of the current lost frame, and n>1.

In Step 204, an excitation signal of the current lost frame is calculated on the basis of the fundamental-tone delay, the adaptive codebook gain, and the adaptive codebook. Thus, the flow is ended.

In Step 205, the fundamental-tone delay of the current lost frame is calculated on the basis of the fundamental-tone delay of the last good frame before the lost frame. A fixed codebook gain of the current lost frame is obtained by attenuating the energy of a fixed codebook gain of the last good frame before the lost frame. Further, a sequence number and a symbol of a fixed codebook of the current lost frame are obtained on the basis of a currently generated random number.

In particular, a fixed codebook gain of the first lost frame in the continual lost frames is set to be identical with the fixed codebook gain of the last good frame before the lost frame. Fixed codebook gains of the second lost frame and lost frames after the second lost frame in the continual lost frames are attenuated with an attenuation coefficient of 0.98 on the basis of the fixed codebook gain of a former lost frame. That is, the fixed codebook gain of the current lost frame is $g_c^n=0.98*g_c^{n-1}$.

n represents the frame number of the current lost frame in the continual lost frames, $g_c^n$ is the fixed codebook gain of the current lost frame, n−1 represents the frame number of the former lost frame of the current lost frame in the continual lost frames, $g_c^{n-1}$ is a fixed codebook gain of the former lost frame of the current lost frame, and n>1.

The process of calculating the sequence number and the symbol of the fixed codebook specifically includes the following steps: first obtaining seed(n) on the basis of seed(n) =seed(n−1)×31821+13849, then adopting 0 to 12th least significant bits of seed(n) as the sequence number of the fixed codebook, and adopting 0 to 3rd least significant bits as the symbol of the fixed codebook, where seed(0)=21845.

In Step 206, the excitation signal of the current lost frame is calculated on the basis of the fundamental-tone delay, the fixed codebook gain, and the sequence number and symbol of the fixed codebook.

The method shown in FIG. 2 employs the fundamental-tone delay of the last good frame before the lost frame to estimate the fundamental-tone delay of the current lost frame, and completely adopts the adaptive codebook or the fixed codebook to recover the excitation signal of the lost frame on the basis of the fact whether the last good frame before the lost frame is speech or non-speech, so that the physiological characteristics of speech can be well compensated. However, in the case of poor network conditions, the compensation effect decreases rapidly. Meanwhile, since only the adaptive codebook excitation or fixed codebook excitation is taken during the recovery of the excitation signal of the lost frame and the fixed codebook excitation is merely a random number, any frame loss may again result in a large deviation of the recovered excitation signal. The higher the frame loss rate is, the larger the deviation will be. Therefore, the signal energy fluctuates greatly before and after the frame loss, and a sharp contrast in a receiver's subjective sensation will occur. Generally, when the frame loss rate is below 2%, this method may achieve a satisfactory effect. However, when the frame loss rate exceeds 2%, the effect is unsatisfactory.

SUMMARY

The present invention provides a device and a method for frame lost concealment, so as to improve the quality of speech of recovered frames when a frame loss on speech occurs.

The technical solutions of the present invention are implemented as follows.

A device for frame lost concealment including a lost frame detection module, a lost frame pitch period determination module, and a lost frame excitation signal determination module is provided.

The lost frame detection module forwards a frame loss indication signal sent from an upper-layer protocol layer.

The lost frame pitch period determination module receives the frame loss indication signal sent from the lost frame detection module, then determines a pitch period of a current lost frame on the basis of a pitch period of the last good frame before the lost frame stored therein, and sends the pitch period of the current lost frame.

The lost frame excitation signal determination module receives and stores an excitation signal of the good frame from the upper-layer protocol layer, and then obtains an excitation signal of the current lost frame on the basis of the pitch period of the current lost frame sent from the lost frame pitch period determination module and the good frame excitation signal stored therein.

A method for frame lost concealment is provided for storing a received good frame excitation signal. The method includes the following steps.

First, a current lost frame is detected, and a pitch period of the current lost frame is obtained on the basis of a pitch period of the last good frame before the lost frame.

Next, an excitation signal of the current lost frame is recovered on the basis of the pitch period of the current lost frame and an excitation signal of the last good frame stored.

In the above device and method, a pitch period of a current lost frame is determined on the basis of a pitch period of the last good frame before the lost frame. An excitation signal of the current lost frame is recovered on the basis of the pitch period of the current lost frame and an excitation signal of the last good frame before the lost frame. Thereby, the hearing contrast of a receiver is reduced, and the quality of speech is improved. Further, in the present invention, a pitch period of continual lost frames is adjusted on the basis of the change trend of the pitch period of the last good frame before the lost frame. Therefore, a buzz effect produced by the continual lost frames is avoided, and the quality of speech is further improved. In addition, by attenuating the energy of the excitation signal obtained from the continual lost frames, the device and method accord with the hearing physiological characteristics of human and reduce the hearing contrast of the receiver.

BRIEF DESCRIPTION OF THE DRAWING(S)

DETAILED DESCRIPTION

The present invention is described in detail below by embodiments with reference to the accompanying drawings.

When a frame loss occurs, with the rising of the frame loss rate, large deviations in effective information and energy level of the whole speech segment during the frame loss may occur. After a linear prediction (LPC) is performed on a segment of continuous speech signals, it is found that frequency spectra of residual signals obtained after the LPC are far from the white noises. It is apparent that distinct sharp pulses exist between the continuous voiced sound areas, so that long-term correlations exist between the excitation signals. Meanwhile, it can be seen clearly that, the correlations of the excitation signals are spaced from each other by an interval of one pitch period or an integral multiple of the pitch period. Since the unvoiced sounds or noises do not have periodic excitation signals, properties such as energy levels of excitation signals of two adjacent unvoiced sounds or noises can be set identical. Therefore, the fundamental-tone delay of the last good frame before the lost frame may be taken as the pitch period of the good frame, and a pitch period of the lost frame is obtained on the basis of the good frame pitch period. After that, an excitation signal of the lost frame is recovered on the basis of the pitch period of the lost frame and an excitation signal of the last good frame before the lost frame.

Figure 1:
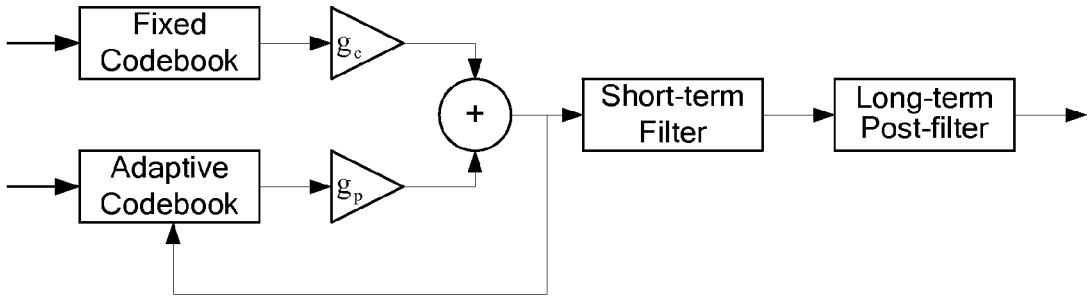
FIG. 1 is a view illustrating principles of signal decoding of G.729.
Figure 2:
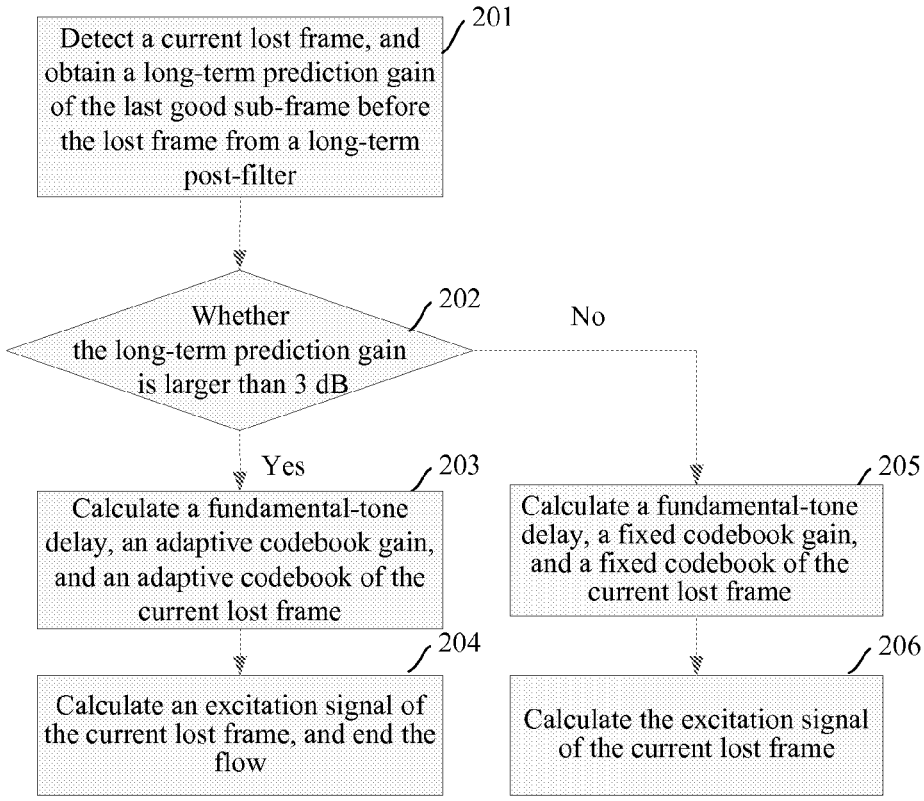
FIG. 2 is a flow chart of a frame lost concealment process proposed in G.729.
Figure 3:
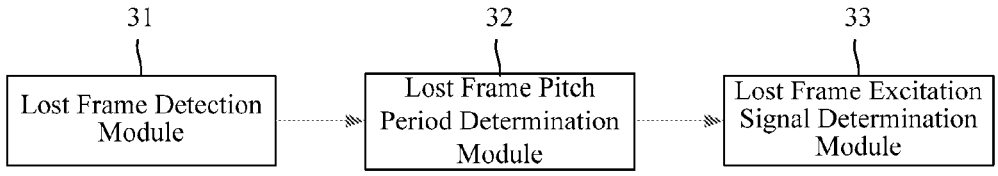
FIG. 3 is a block diagram of a device for frame lost concealment according to the present invention.

FIG. 3 is a block diagram of a device for frame lost concealment according to the present invention. Referring to FIG. 3, the device mainly includes a lost frame detection module 31, a lost frame pitch period determination module 32, and a lost frame excitation signal determination module 33.

The lost frame detection module 31 is adapted to forward a frame loss indication signal sent from an upper-layer protocol layer to the lost frame pitch period determination module 32.

The lost frame pitch period determination module 32 is adapted to receive the frame loss indication signal sent from the lost frame detection module 31, then determine a pitch period of a current lost frame on the basis of a pitch period of the last good frame before the lost frame stored therein, and send the pitch period of the current lost frame to the lost frame excitation signal determination module 33.

The lost frame excitation signal determination module 33 is adapted to receive an excitation signal of the good frame coming from the upper-layer protocol layer, store the excitation signal of the good frame in a buffer thereof, receive the pitch period of the current lost frame sent from the lost frame pitch period determination module 32, and then obtain an excitation signal of the current lost frame on the basis of the pitch period and the excitation signal of the good frame stored therein.

Figure 4:
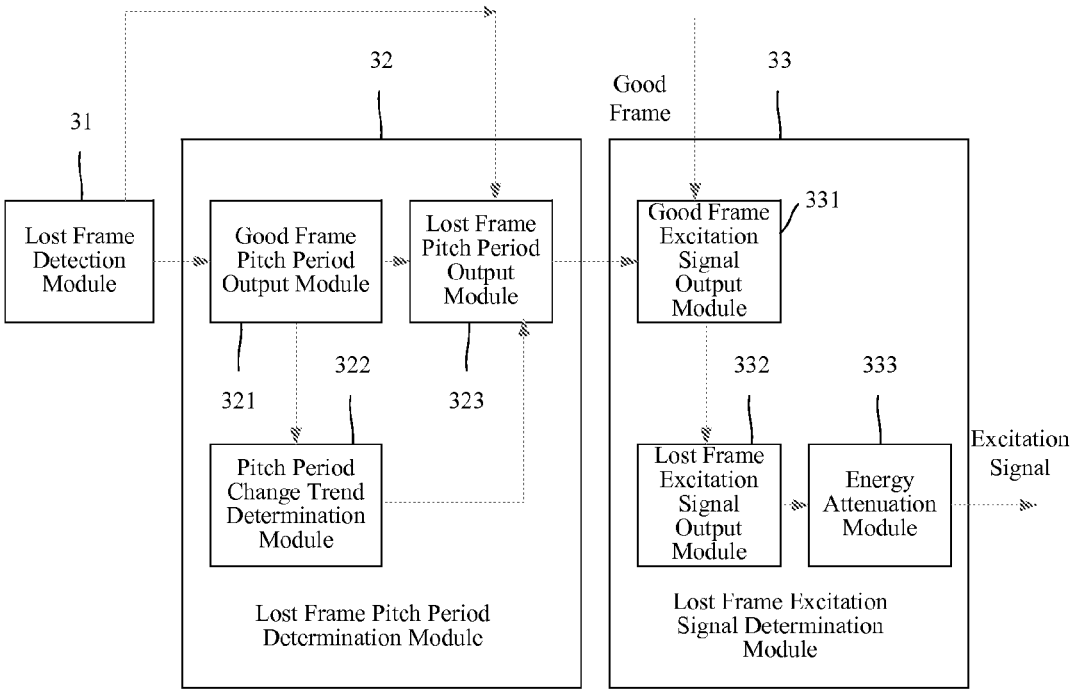
FIG. 4 is a block diagram of a device for frame lost concealment according to a specific embodiment of the present invention.

Further, referring to FIG. 4, the lost frame pitch period determination module 32 includes a good frame pitch period output module 321, a pitch period change trend determination module 322, and a lost frame pitch period output module 323.

The good frame pitch period output module 321 is adapted to store pitch periods of sub-frames of each good frame, then receive a trigger signal sent from the lost frame detection module 31, and output the stored pitch periods of the sub-frames of the last good frame to the pitch period change trend determination module 322 and the lost frame pitch period output module 323.

The pitch period change trend determination module 322 is adapted to receive the pitch periods of the sub-frames of the last good frame sent from the good frame pitch period output module 321, and determine whether the pitch period of the good frame is in a decreasing trend. If yes, a trigger signal 1 is sent to the lost frame pitch period output module 323; otherwise, a trigger signal 0 is sent to the lost frame pitch period output module 323.

The lost frame pitch period output module 323 is adapted to receive a frame number of the current lost frame in continual lost frames sent from the lost frame detection module 31. If the trigger signal 1 from the pitch period change trend determination module 322 is received, a value obtained by subtracting the sampling point durations (the number of the sampling point durations is the same as the frame number of the current frame in the continual lost frames) from the pitch period of the last good sub-frame in the last good frame sent from the good frame pitch period output module 321 and then adding one sampling point duration serves as the pitch period of the current lost frame. On the contrary, if the trigger signal 0 from the pitch period change trend determination module 322 is received, a value obtained by adding the sampling point durations (the number of the sampling point is the same as the frame number of the current frame in the continual lost frames) to the pitch period of the last good sub-frame sent from the good frame pitch period output module 321 and then subtracting one sampling point duration serves as the pitch period of the current lost frame. Afterward, the lost frame pitch period output module 323 outputs the pitch period of the current frame to the lost frame excitation signal determination module 33.

Further, referring to FIG. 4, the lost frame excitation signal determination module 33 includes a good frame excitation signal output module 331 and a lost frame excitation signal output module 332.

The good frame excitation signal output module 331 is adapted to receive and store the excitation signal of the good frame coming from the upper-layer protocol layer, receive the pitch period of the current lost frame output by the lost frame pitch period determination module 32, overlap and add an excitation signal of the last $$\frac{1}{m}(m > 1)$$

pitch periods of the current lost frame, i.e., having a length of $$\frac{T_n}{m}$$

stored therein with an excitation signal of the last 1 to $$\left(1 + \frac{1}{m}\right)$$

pitch periods of the current lost frame, and adopt the obtained excitation signal as the excitation signal of the last $$\frac{1}{m}$$

pitch periods of the current lost frame. After that, the good frame excitation signal output module 331 adopts the excitation signal of the last $$\frac{1}{m}$$

to 1 pitch periods of the current lost frame stored therein as the excitation signal of 0 to $$\left(1-\frac{1}{m}\right)$$

pitch periods of the current lost frame, and outputs the obtained excitation signal of one pitch period of the current lost frame to the lost frame excitation signal output module 332.

The lost frame excitation signal output module 332 is adapted to sequentially and repeatedly write the excitation signal of one pitch period sent from the good frame excitation signal output module 331 into a buffer thereof for the excitation signal of the current lost frame.

Further, referring to FIG. 4, the lost frame excitation signal determination module 33 also includes an energy attenuation module 333 adapted to attenuate the energy of the excitation signal of the current lost frame sent from the lost frame excitation signal output module 332.

Figure 5:
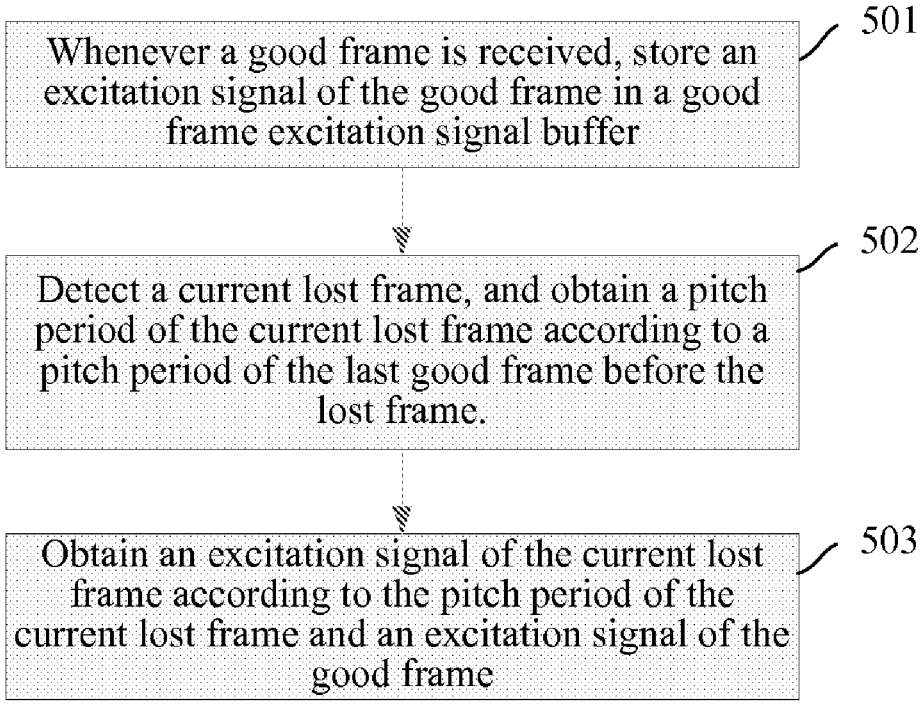
FIG. 5 is a flow chart of a frame lost concealment process of the present invention.

FIG. 5 is a flow chart of a frame lost concealment process of the present invention. Referring to FIG. 5, the process includes the following steps.

In Step 501, whenever a good frame is received, an excitation signal of the good frame is stored in a good frame excitation signal buffer.

The length of the buffer may be set by experience.

In Step 502, a current lost frame is detected, and a pitch period of the current lost frame is determined on the basis of a pitch period of the last good frame before the lost frame.

In Step 503, an excitation signal of the current lost frame is determined on the basis of the pitch period of the current lost frame and an excitation signal of the good frame before the lost frame.

Figure 6:
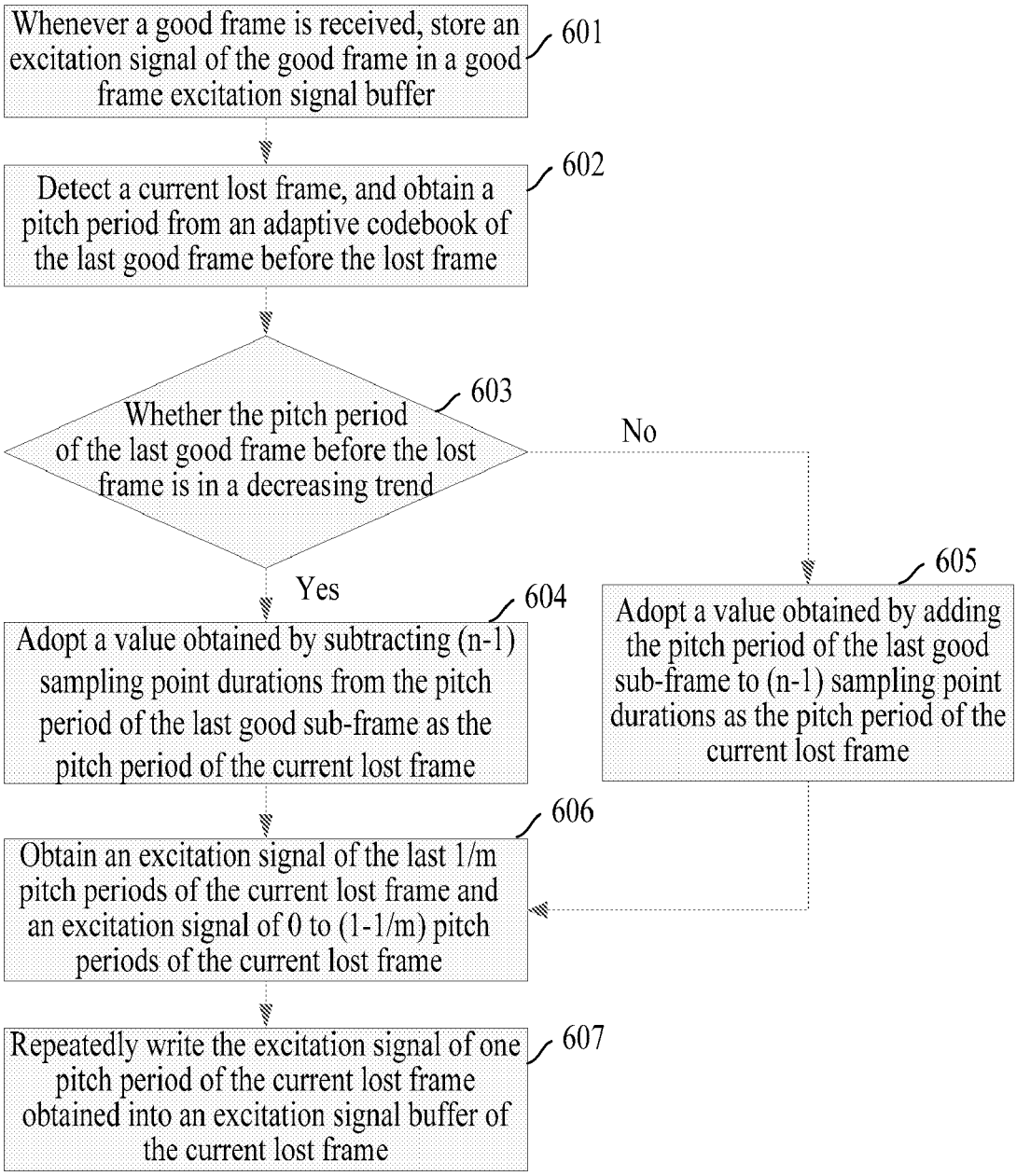
FIG. 6 is a flow chart of a frame lost concealment process according to a specific embodiment of the present invention.

FIG. 6 is a flow chart of a frame lost concealment process according to a specific embodiment of the present invention. Referring to FIG. 6, the process includes the following specific steps.

In Step 601, whenever a good frame is received, an excitation signal of the good frame is stored in a good frame excitation signal buffer.

The length of the buffer may be set by experience.

In Step 602, a current lost frame is detected, and pitch periods of sub-frames contained in the last good frame before the lost frame are obtained from an adaptive codebook of the last good frame before the lost frame.

In Step 603, it is determined whether the pitch period of the last good frame before the lost frame is in a decreasing trend. If yes, Step 604 is performed; otherwise, Step 605 is performed.

In the G.729, each frame is 10 ms long, and can be divided into two 5 ms long sub-frames. It can be known whether the pitch period of the last good frame before the lost frame is in a decreasing trend by comparing lengths of pitch periods of two sub-frames of the last good frame before the lost frame. If the pitch periods of the two sub-frames of the last good frame before the lost frame are identical, the pitch period of the last good frame before the lost frame is considered in a decreasing trend.

In Step 604, a value obtained by subtracting n−1 sampling point durations from the pitch period T0 of the last good sub-frame before the lost frame serves as a pitch period Tn of the current lost frame, and then Step 606 is performed. In this step, n is a frame number of the current lost frame in continual lost frames.

Further, an integer Td ($20 \leqq Td \leqq 143$) is preset, and it is determined whether n>Td. If yes, the pitch period Tn of the current lost frame equals the pitch period T0 of the last good frame minus Td sampling point durations; otherwise, Tn equals the pitch period T0 of the last good sub-frame before the lost frame minus n−1 sampling point durations.

In Step 605, a value obtained by adding the pitch period T0 of the last good sub-frame before the lost frame to n−1 sampling point durations serves as the pitch period Tn of the current lost frame, and then Step 606 is performed. In this step, n is the frame number of the current lost frame in the continual lost frames.

Further, an integer Td ($20 \leqq Td \leqq 143$) is preset, and it is determined whether n>Td. If yes, the pitch period Tn of the current lost frame equals the pitch period T0 of the last good frame plus Td sampling point durations; otherwise, Tn equals the pitch period T0 of the last good sub-frame before the lost frame plus n−1 sampling point durations.

Since the pitch period changes gently during the stable voiced sound period, the pitch period of the first lost frame may be considered identical with that of the last good sub-frame before the lost frame when n=1.

In Step 606, an excitation signal of the last $$\frac{1}{m}(m>1)$$

pitch periods of the current lost frame, i.e., having a length of $$\frac{T_n}{m}$$

stored in the good frame excitation signal buffer, is overlapped and added with an excitation signal of the last 1 to $$\left(1+\frac{1}{m}\right)$$

pitch periods of the current lost frame, and the obtained excitation signal serves as the excitation signal of the last $$\frac{1}{m}$$

pitch periods of the current lost frame. Further, the excitation signal of the last $$\frac{1}{m}$$

to 1 pitch periods of the current lost frame stored in the good frame excitation signal buffer serves as the excitation signal of 0 to $$\left(1-\frac{1}{m}\right)$$

pitch periods of the current lost frame.

An overlap-add window may be a triangular window or a Hanning window. In the case of the triangular window, the process of overlapping and adding includes the following steps. The excitation signal of the last $$\frac{1}{m}$$

pitch periods of the current lost frame stored in the good frame excitation signal buffer is multiplied by a descending slope of the window function. Then, the excitation signal of the last 1 to $$\left(1+\frac{1}{m}\right)$$

pitch periods of the current lost frame stored in the good frame excitation signal buffer is multiplied by an ascending slope of the window function. Finally, the above two products are added.

Further, in order to avoid buzzing, the energy of the excitation signal of the current lost frame may be attenuated, and an energy attenuation formula is given below:

$$g_n=(a)^{n-1}g_0$$

n is a frame number of the current lost frame in continual lost frames, $g_n$ is the energy of the current lost frame, $g_0$ is the energy of the last good frame before the lost frame, a is the energy attenuation coefficient, and usually a=0.9.

In Step 607, the excitation signal of one pitch period of the current lost frame obtained is sequentially and repeatedly written into an excitation signal buffer of the current lost frame.

Specifically, the data pointer of the excitation signal of the current lost frame is pointed at a start position of the excitation signal of one pitch period of the current lost frame obtained above, and the excitation signal of one pitch period obtained above is then sequentially replicated to the excitation signal buffer of the current lost frame. If the pitch period of the current lost frame obtained in Step 604 or 605 is shorter than the length of the current lost frame, 10 ms, the data pointer returns to the start position of the excitation signal of one pitch period obtained above after moving to an end position of the excitation signal of one pitch period obtained above.

The above descriptions are merely about the embodiments of the process and method of the present invention, and may not limit the scope of the invention. Any modifications, equivalent substitutions, and variations made within the spirit and principle of the present invention fall within the scope of the same.

What is claimed is:

1. A device for frame lost concealment, wherein the device is configured to implement modules utilized for speech signal decoding, the device comprising:

a lost frame detection module, configured to output a frame lost indication signal;

a lost frame pitch period determination module, configured to receive the frame lost indication signal sent by the lost frame detection module, determine a pitch period of a current lost frame on the basis of a pitch period of the last good frame stored therein before the lost frame, and send the pitch period of the current lost frame; and a lost frame excitation signal determination module, configured to receive and store an excitation signal of the good frame sent from the upper-layer protocol layer, obtain an excitation signal of the current lost frame on the basis of the pitch period of the current lost frame sent from the lost frame pitch period determination module and the excitation signal stored therein;

wherein the lost frame excitation signal determination module comprises:

a good frame excitation signal output module, configured to receive and store the excitation signal of the good frame sent from the upper-layer protocol layer, receive the pitch period of the current lost frame output by the lost frame pitch period determination module, overlap and add an excitation signal of the last $$\frac{1}{m}$$

pitch periods of the current lost frame with an excitation signal of the last 1 to $$\left(1+\frac{1}{m}\right)$$

pitch periods of the current lost frame, and adopt the obtained excitation signal as the excitation signal of the last $$\frac{1}{m}$$

pitch periods of the current lost frame; adopt the excitation signal of the last $$\frac{1}{m}$$

to 1 pitch periods of the current lost frame stored therein as the excitation signal of 0 to $$\left(1-\frac{1}{m}\right)$$

pitch periods of the current lost frame; output the obtained excitation signal of one pitch period of the current lost frame, wherein the m is greater than 1;

a lost frame excitation signal output module, configured to sequentially and repeatedly write the excitation signal of one pitch period sent from the good frame excitation signal output module into a buffer thereof for the excitation signal of the current lost frame.

2. The device of claim 1, wherein the lost frame pitch period determination module comprises:

a good frame pitch period output module, configured to store pitch periods of sub-frames of each good frame, and output the stored pitch periods of the sub-frames of the last good frame in response to the frame lost indication signal sent by the lost frame detection module;

a pitch period change trend determination module, configured to determine whether the pitch periods of the sub-frames of the last good frame sent from the good frame pitch period output module are in a decreasing trend; if the pitch periods of the sub-frames of the last good frame are in a decreasing trend, sending a trigger signal 1; otherwise, sending a trigger signal 0;

a lost frame pitch period output module, configured to receive a frame number of the current lost frame in continual lost frames sent from the lost frame detection module; if the trigger signal 1 from the pitch period change trend determination module is received, obtain the pitch period of the current lost frame by subtracting the sampling point durations (the number of the sampling point durations is the same as the frame number of the current frame in the continual lost frames) from the pitch period of the last good sub-frame in the last good frame sent from the good frame pitch period output module and then adding one sampling point duration; if the trigger signal 0 from the pitch period change trend determination module is received, obtain the pitch period of the current lost frame by adding the sampling point durations (the number of the sampling point durations is the same as the frame number of the current frame in the continual lost frames) to the pitch period of the last good sub-frame sent from the good frame pitch period output module and then subtracting one sampling point duration; send the pitch period of the current frame to the lost frame excitation signal determination module.

3. The device of claim 1, wherein the lost frame excitation signal determination module further comprises:

an energy attenuation module, configured to attenuate the energy of the excitation signal of the current lost frame sent from the lost frame excitation signal output module.

4. A method for frame lost concealment, storing an excitation signal of the received good frame, comprising:

A. when a current lost frame is detected, obtaining a pitch period of the current lost frame on the basis of a pitch period of the last good frame before the lost frame;

B. recovering an excitation signal of the current lost frame on the basis of the pitch period of the current lost frame and the stored excitation signal of the good frame wherein the step B further comprises:

overlapping and adding a stored excitation signal of the last $$\frac{1}{m}$$

pitch periods of the current lost frame with an excitation signal of the last 1 to $$\left(1+\frac{1}{m}\right)$$

pitch periods of the current lost frame, and adopting the obtained excitation signal as the excitation signal of the last $$\frac{1}{m}$$

pitch periods of the current lost frame;

adopting a stored excitation signal of the last $$\frac{1}{m}$$

to 1 pitch periods of the current lost frame as an excitation signal of 0 to $$\left(1-\frac{1}{m}\right)$$

pitch periods of the current lost frame;

sequentially storing the obtained excitation signal of one pitch period of the current lost frame, wherein the k is greater than 1.

5. The method of claim 4, wherein the obtaining a pitch period of the current lost frame on the basis of a pitch period of the last good frame before the lost frame further comprises:

A1. obtaining pitch periods of the sub-frames contained in the last good frame before the lost frame from an adaptive codebook of the last good frame before the lost frame, determining whether the pitch period of the last good frame before the lost frame is in a decreasing tread, if the pitch period of the last good frame before the lost frame is in a decreasing tread, performing step A2; otherwise, performing step A3;

A2. obtaining the pitch period of the current lost frame by subtracting the sampling point durations (the number of the sampling point durations is the same as the frame number of the current frame in the continual lost frames) from the pitch period of a last good sub-frame before the lost frame and then adding one sampling point duration, turning to the step B;

A3. obtaining the pitch period of the current lost frame by adding the sampling point durations of the same number as the frame number of the current frame in the continual lost frames to the pitch period of a last good sub-frame before the lost frame and then subtracting one sampling point duration, turning to the step B.

6. The method of claim 5, before the step A2, the method further comprising:

determining whether the frame number of the current frame in continual lost frames is greater than a preset value, if the frame number of the current frame in continual lost frames is greater than a preset value, obtaining the pitch period of the current lost frame by subtracting the preset value sampling point durations from the pitch period of a last good sub-frame before the lost frame; otherwise, performing the step A2.

7. The method of claim 6, wherein the preset value is any integer between 20 and 143.

8. The method of claim 5, before the step A3, further comprising:

determining whether the frame number of the current frame in continual lost frames is greater than a preset value, if the frame number of the current frame in continual lost frames is greater than a preset value, obtaining the pitch period of the current lost frame by adding the sampling point durations of the preset value to the pitch period of a last good sub-frame before the lost frame; otherwise, performing the step A3.

9. The method of claim 8, wherein the preset value is any integer between 20 and 143.

10. The method of claim 4, after the step B, further comprising:

attenuating the energy of the excitation signal of the current lost frame.

11. The method of claim 4, wherein the overlapping and adding the stored excitation signal of the last $$\frac{1}{m}$$

pitch periods of the current lost frame with the excitation signal of the last 1 to $$\left(1+\frac{1}{m}\right)$$

pitch periods of the current lost frame comprises:

multiplying the stored excitation signal of the last $$\frac{1}{m}$$

pitch periods of the current lost frame by a descending slope of a triangular window function;

multiplying the stored excitation signal of the last 1 to $$\left(1+\frac{1}{m}\right)$$

pitch periods of the current lost frame by a ascending slope of the triangular window function;

adding the above two products.

* * * * *